United States Patent [19]

Torazzi

[11] 3,973,632

[45] Aug. 10, 1976

[54] RIPPER FOR TRACTORS AND SIMILAR VEHICLES

[75] Inventor: Franco Torazzi, Turin, Italy

[73] Assignee: Gimac S.p.A., Torine-se-Turin, Italy

[22] Filed: June 4, 1975

[21] Appl. No.: 584,080

[30] Foreign Application Priority Data

June 6, 1974 Italy ..... 68778/74

[52] U.S. Cl. ..... 172/474; 172/699

[51] Int. Cl.[2] ..... A01B 13/08; A01B 63/10; A01B 63/102

[58] Field of Search ..... 172/699, 474, 475, 315, 172/614, 615, 616, 663, 668, 10, 458

[56] References Cited

UNITED STATES PATENTS

| | | | |
|---|---|---|---|
| 3,269,464 | 8/1966 | Smelcer | 172/10 |
| 3,752,239 | 8/1973 | Kelly | 172/699 |
| 3,807,508 | 4/1974 | Kelly | 172/699 X |
| 3,831,684 | 8/1974 | Thigpen | 172/699 X |
| 3,887,015 | 6/1975 | Kelly | 172/699 X |
| 3,901,328 | 8/1975 | Stanfield | 172/699 |

FOREIGN PATENTS OR APPLICATIONS

| | | | |
|---|---|---|---|
| 1,253,937 | 11/1971 | United Kingdom | 172/699 |

*Primary Examiner*—Paul E. Shapiro
*Attorney, Agent, or Firm*—Sughrue, Rothwell, Mion, Zinn & Macpeak

[57] ABSTRACT

A scarifier or ripper attachment for a tractor or like vehicle, comprising a support structure carrying a pivoted arm on the free end of which is a pivoted tool-carrying frame. The elevation of the arm is controlled by an hydraulic elevation actuator and the inclination of the tool with respect to the arm is controlled by an hydraulic attitude control actuator. The hydraulic circuit of the two actuators includes an auxiliary distributor having three positions in one of which the two actuators are connected in series so that one retracts when the other extends, and in the other two of which one or the other actuator is isolated so that the other can be controlled independently. The relative diameters of the two actuators are such that in the first position of the auxiliary distributor the tool is held in a fixed orientation in relation to the ground as the arm is turned through its full angle.

3 Claims, 8 Drawing Figures

RIPPER FOR TRACTORS AND SIMILAR VEHICLES

The present invention relates to scarifier devices formed as attachments for tractors and like vehicles.

Known scarifier devices, sometimes termed "rippers", comprise a support structure adapted to be fixed to the rear of a tractor or other vehicle, an arm in the form of a shaped plate, pivoted at one end to the support structure and connected at the other end to a shaped tool-carrying frame to which is attached at least one ripper tool, and one or more hydraulic actuators, which interconnect the fixed support structure and the hinged arm and are operable to displace the arm and therefore the ripper tool, with respect to the ground.

Normally such known ripper devices are constructed in one of two forms; in one form, the so called "radially operating" form, the tool-carrying frame is rigidly connected to the hinged arm, and consequently the inclination of the ripper tool to the vertical changes with changes in the inclination of the arm when the arm is raised or lowered, thus varying the angle of incidence between the tool and the ground. In the other form, known as the "parallelogram-type", the tool-carrying frame is connected to the fixed support structure by means of two separate pivoted arms so as to form a parallelogram linkage which allows the ripper tool to maintain a constant angle of inclination with respect to the ground, independently of the inclination of the lifting arms (see for example, United Kingdom Pat. No. 976,066).

There is also a known type of ripper device (see United Kingdom Pat. No. 1.232.647) which has in addition to one or more hydraulic actuators extending between the fixed structure and the pivoted arm for controlling the elevation of the arm, at least one hydraulic actuator connected to the tool-carrying frame in such a manner as to be able selectively to vary its angle of inclination in relation to the pivoted arm.

With this known construction it is possible to set the system for parallelogram-type operation by setting the actuator (s) which control (s) the inclination of the tool with respect to the pivoted arm to such a length that the distance between the fulcra at each end thereof is equal to the distance between the fulcra at each end of the pivoted arm itself.

In order to facilitate the setting up of this system for parallelogram-type operation it is convenient to use suitable indexing devices. Once the system is set up subsequent extension or retraction of the actuators which control the elevation of the pivoted arm does not change the inclination of the ripper tool. There may also be provision for locking the actuators during use of the tool and provision for the variation of the inclination of the ripper relatively to the pivoted arm by operating the actuator or actuators extending between the fixed structure and the tool-carrier frame. Theoretically, there are other possible modes of operation. For example, by simultaneously controlling the actuators of the two groups, it would be possible (in theory) to obtain a "radial" type of operation in which the ripper tool does not vary its inclination relatively to the pivoted arm when the arm changes its position relatively to the fixed structure on which it is hingedly mounted. For this mode of operation it would be essential to actuate simultaneously both the actuator or actuators which change the position of the pivoted arm and the actuator or actuators which change the angle of inclination of the ripper tool relative to this arm. The correct handling of the controls to obtain such an operation would be extremely difficult, however, and for this reason, this known structure is not used for the "radial"-type operation.

The present invention seeks to provide a ripper device of the type having at least one actuator for controlling the elevation of an arm on which a tool support frame is mounted, and at least one actuator for controlling the inclination of a ripper tool with respect to this arm, in which this disadvantage of known ripper devices is avoided.

According to the present invention there is provided a ripper device for attachment to tractors and like vehicles, of the type comprising, a support structure for attachment to a tractor or the like, an arm pivotally mounted at one end on the support structure, a tool-carrying frame pivotally mounted at the other end of the arm, at least one elevation control fluid pressure actuator interconnecting the support structure and the arm and operable upon extension and retraction, to control the inclination of the arm, and at least one attitude control fluid pressure actuator connected at one end to the tool-carrying frame and operable upon extension and retraction to control the inclination of the tool-carrying frame with respect to the said arm, and a main control distributor for feeding the said hydraulic actuators to extend or retract, characterised in that in the fluid pressure circuit, between the said main control distributor and the two actuators, there is provided an auxiliary distributor having three selectable positions, a first position (*a*), in which the two actuators are interconnected in series so that fluid displaced from one is fed to the other in such a way that retraction of one actuator causes extension of the other, a second position (*b*), in which the elevation control actuator is isolated from the main control distributor whereby operation of the main control distributor causes only extension and retraction of the attitude control actuator, and a third position (*c*), in which the attitude control actuator is isolated from the main control distributor such that operation of the main control distributor causes only extension or retraction of the elevation control actuator, the relative diameters of the elevation control and attitude control actuators being such that when the auxiliary distributor is in the first position thereof the angle turned by the tool-carrying frame with respect to the arm is substantially equal and opposite to the angle turned through by the arm with respect to the fixed support structure for a given displacement of the elevation control actuator whereby the device acts in the same manner as a parallelogram linkage.

In one embodiment of the invention, the end of the attitude control actuator remote from the tool-carrying frame is pivotally connected to the arm adjacent the pivot connecting the arm to the fixed support structure.

In another embodiment of the invention the end of the attitude control actuator remote from the tool-carrying frame is pivotally connected to the fixed support structure adjacent the pivot connecting the arm to the fixed support structure.

Thus, with embodiments of the present invention it is possible to operate in the "radial arm" mode by selecting the third position of the auxiliary distributor or in the "parallelogram" mode by selecting the first position of the auxiliary distributor, without in either case having to perform complicated control operations requiring special ability on the part of the person operating the device. It is also possible to operate with a fixed arm and an adjustable inclination of the ripper tool.

Two embodiments of the present invention will now be more particularly described, by way of example, with reference to the accompanying drawings, in which:-

In all the Figures corresponding elements have been indicated by the same reference numbers.

Figure 1:
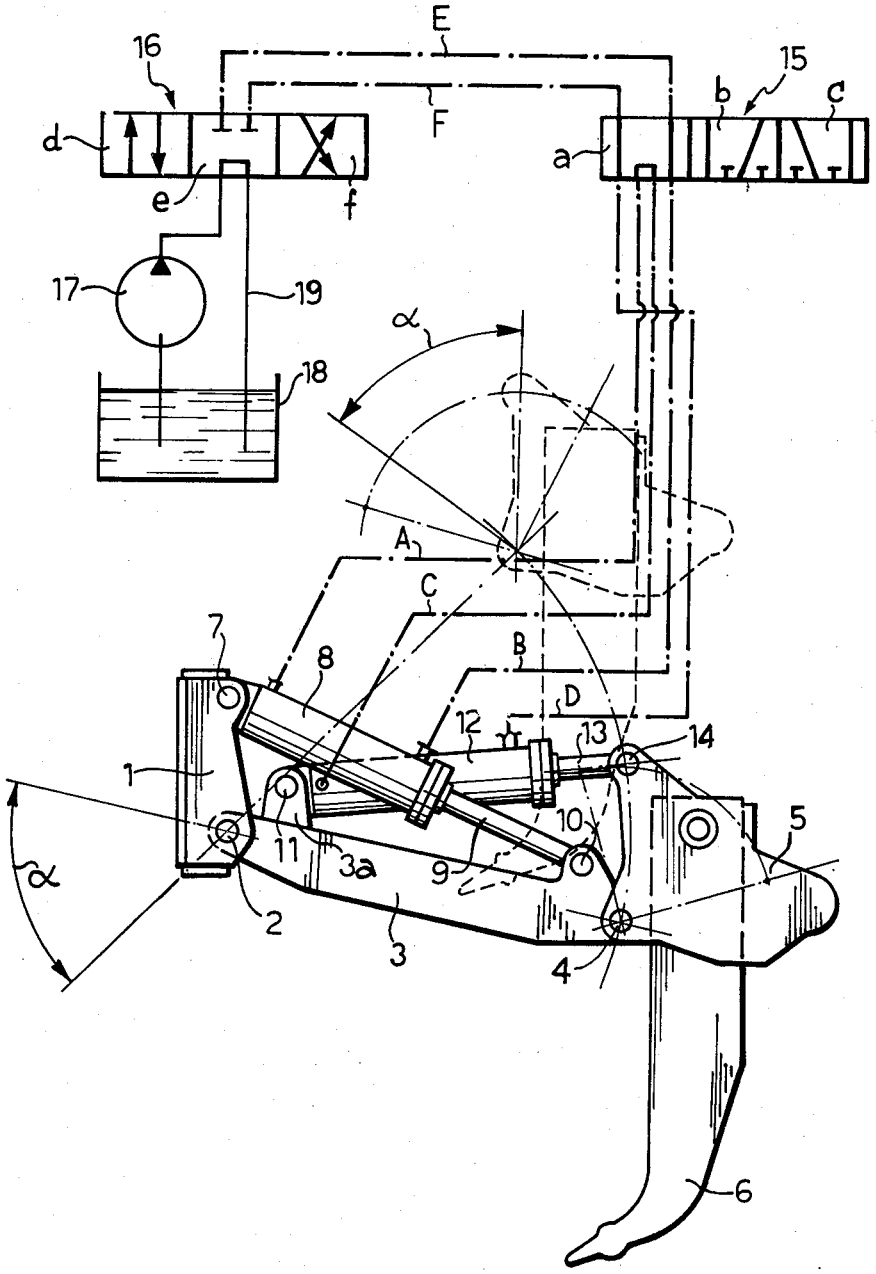
FIG. 1 is a schematic side view of a first embodiment of the invention, set up for the "parallelogram-type" of operation with a vertically disposed scarifier tool.
Figure 2:
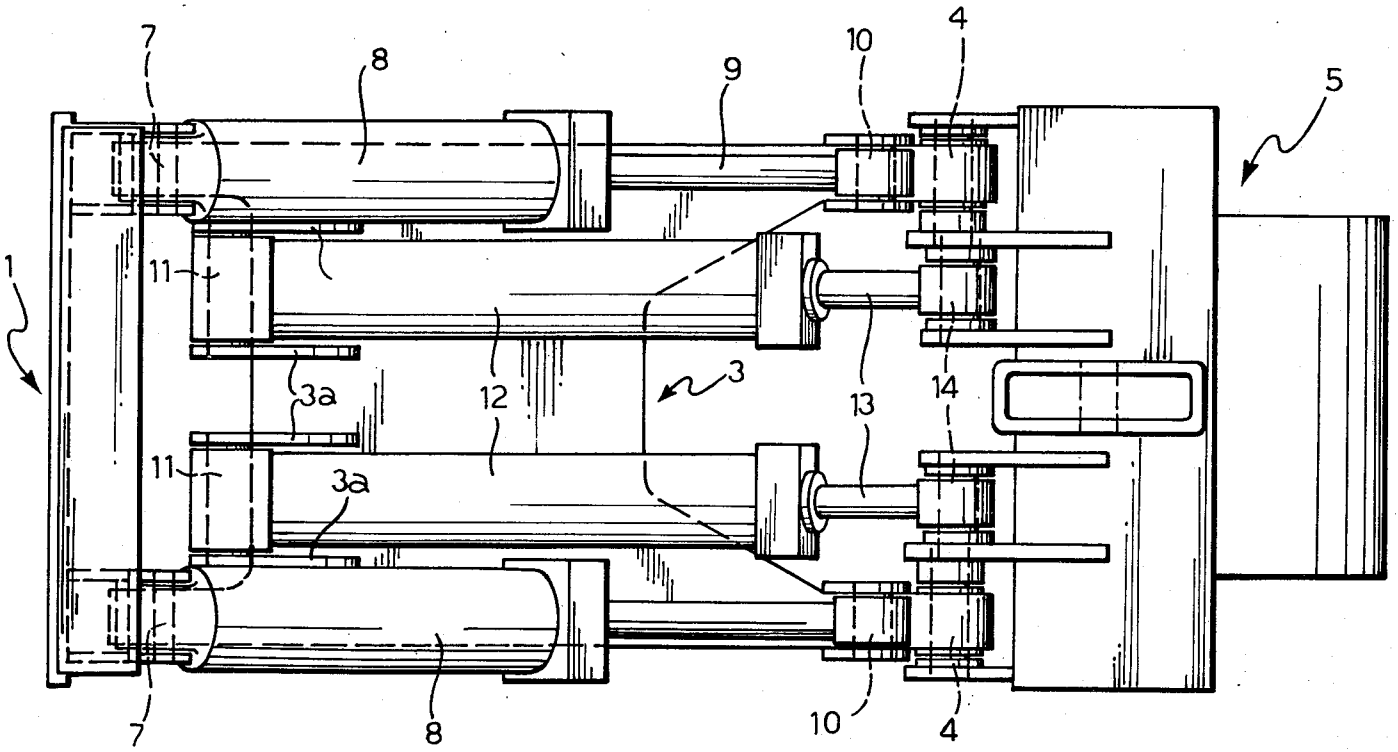
FIG. 2 is a schematic plan view of the embodiment of FIG. 1 on an enlarged scale.
Figure 3:
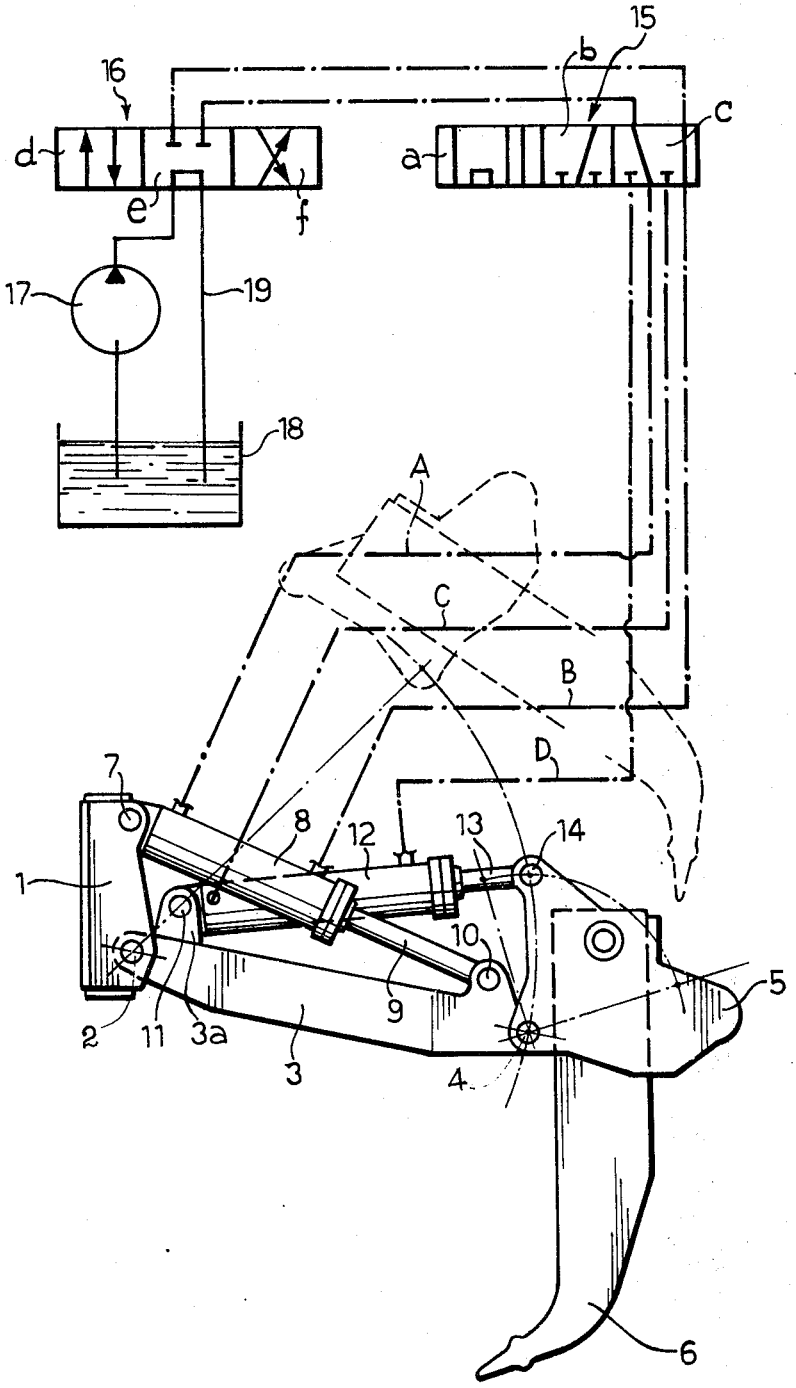
FIG. 3 is a side view similar to that of FIG. 1, showing the device embodiment set up for the "radial" type of operation.
Figure 4:
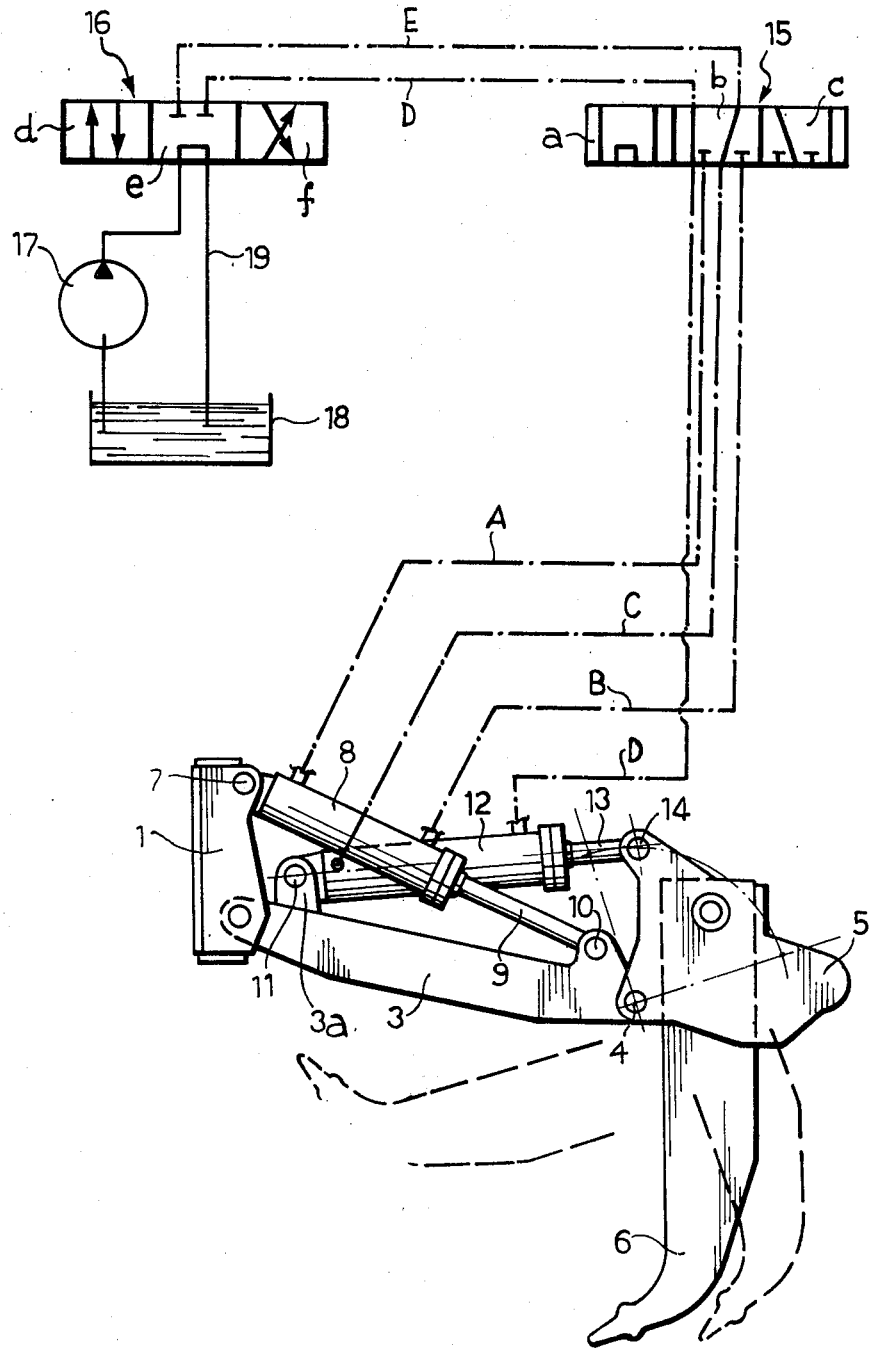
FIG. 4 is a side view similar to that of FIGS. 1 and 3, showing the embodiment set up so that there can be variations of the attitude of the tool relative to the ground during use.
Figure 5:
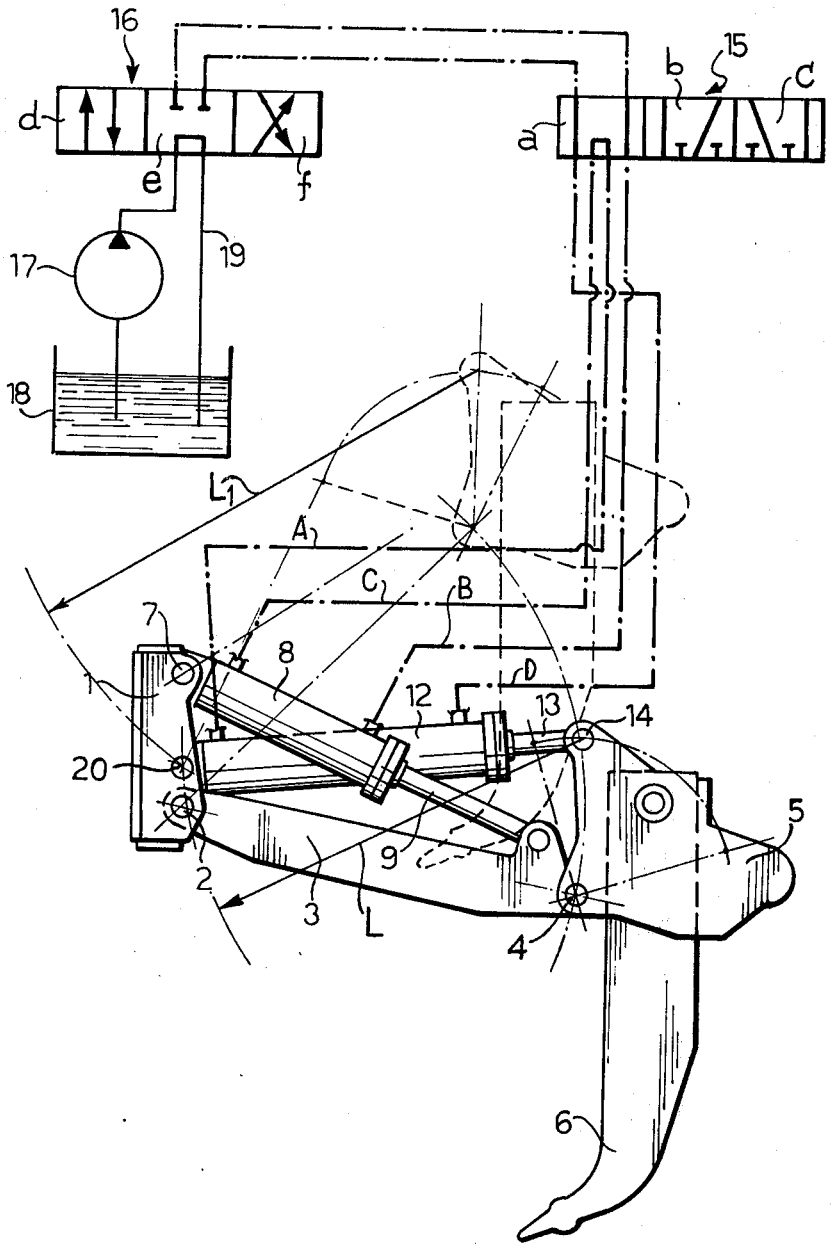
FIG. 5 is a schematic side view of a second embodiment of the invention arranged for the "parallelogram-type" of operation.
Figure 6:
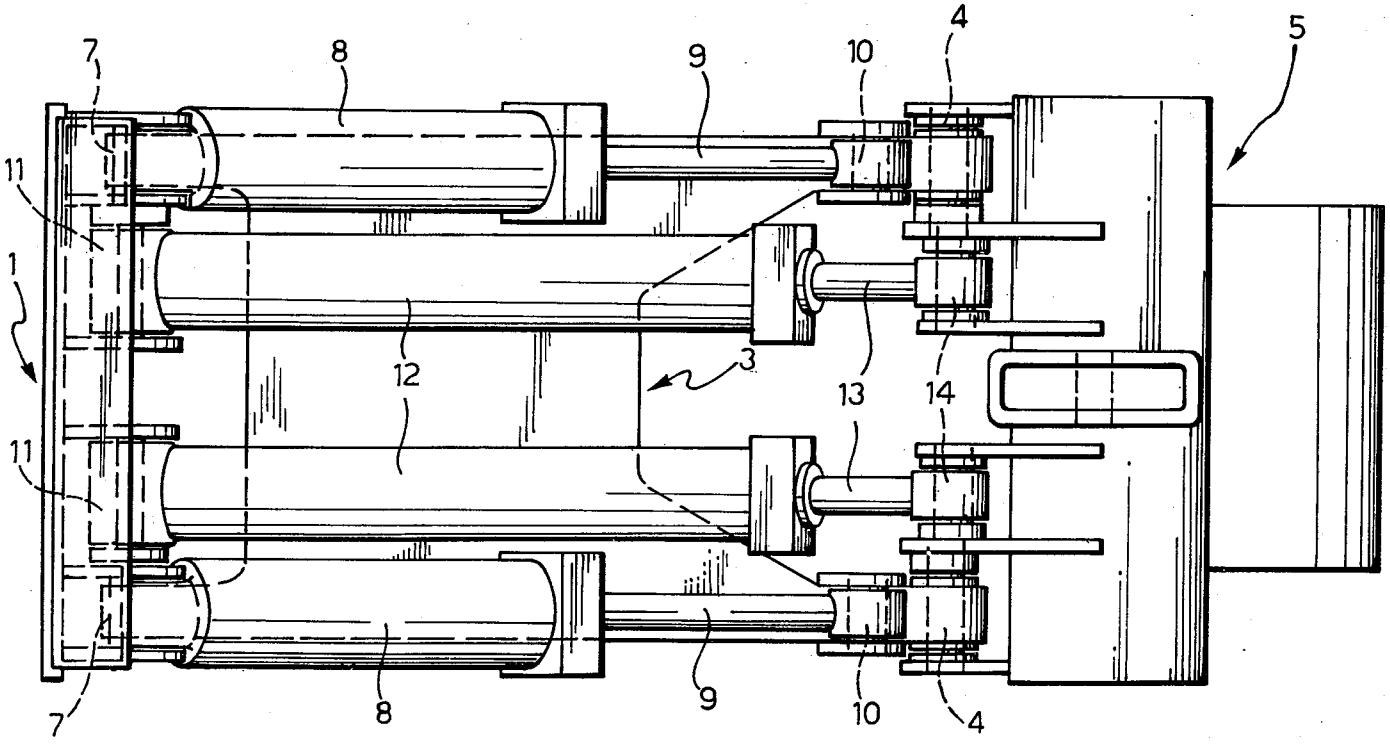
FIG. 6 is a schematic plan view of an enlarged scale of the embodiment of FIG. 5.
Figure 7:
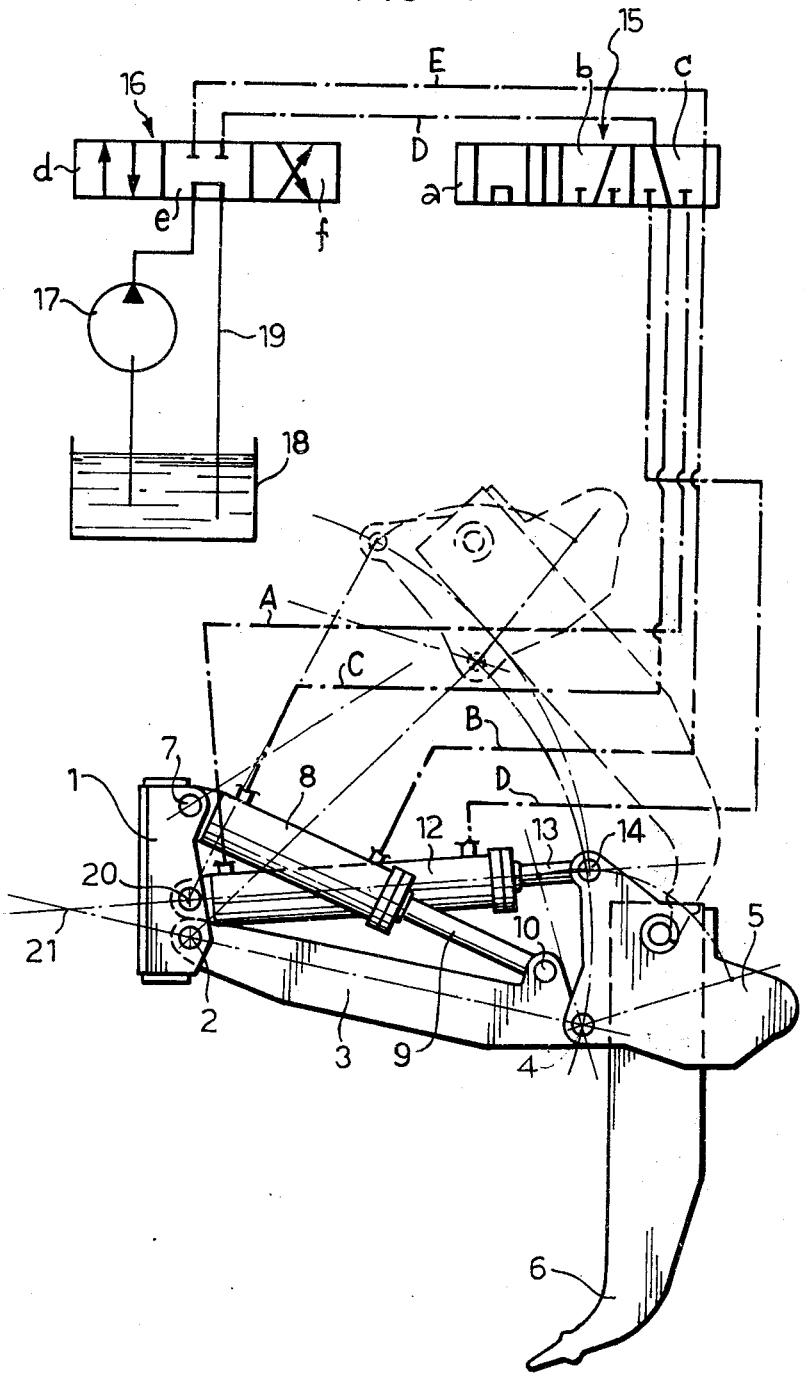
FIG. 7 is a schematic side view similar to that of FIG. 5, showing the device arranged for the "radial-type" of operation.
Figure 8:
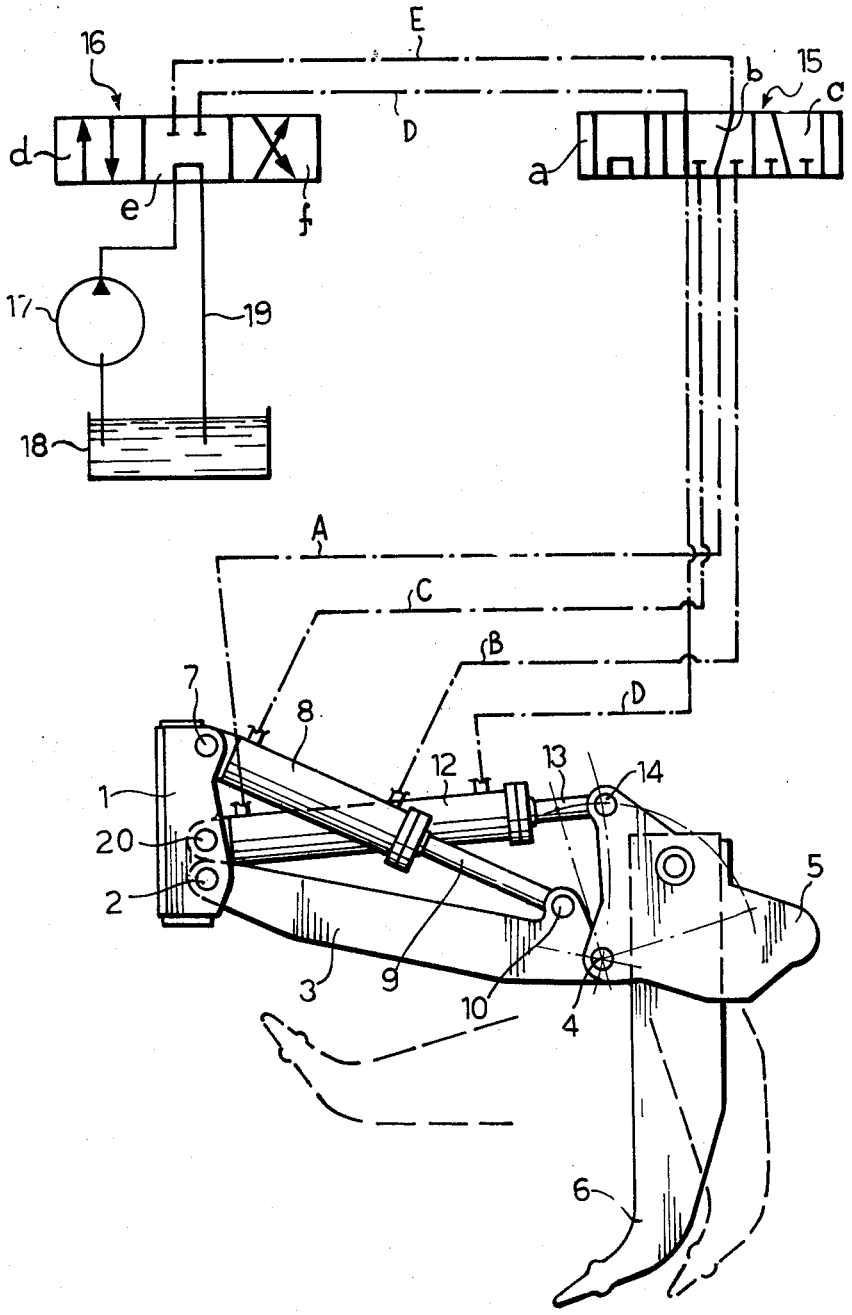
FIG. 8 is a schematic side view similar to that of FIGS. 5 and 7, showing the device set up so that the attitude of the tool relative to the ground can be changed during use.

With reference now to FIGS. 1 and 2, which illustrate a first embodiment of the invention, there is shown a support structure 1 which is adapted to be fixed onto the rear of a tractor or similar vehicle. Near the base of the support structure 1 there is pivotally connected, by means of two coaxial horizontal pins 2, an arm 3 which in the illustrated embodiment, is formed of a shape plate which is bifurcated to form two free ends to which there is mounted, by means of a pair of coaxial horizontal pins 4, a tool-carrying frame 5 capable of supporting one or more scarifiers or rippers 6 which are attached to it by known means (not illustrated). Adjacent the upper end of the support structure 1 there are connected, by means of horizontal pins 7 located above the pins 2, a pair of identical hydraulic elevation control actuators 8 each in the form of a cylinder within which slides a piston (not shown) attached fixedly to a piston rod 9. The piston rods 9 are connected by means of pins 10, to the swinging arms 3 adjacent the free ends of the arms 3. Each arm 3, adjacent its pivoted end, carries a pair of upstanding lugs forming brackets 3*a* to which are pivoted, by means of pins 11, respective attitude control hydraulic actuators 12 similar to the actuators 8 and comprising a cylinder within which slides a piston (not shown) to which is attached a piston rod, the free end of which is pivoted by means of a pin 14 to the top of the tool-carrying frame 5.

Both the actuators 8 and the actuators 12 are double acting and are connected by pipes A, B, C, D to an hydraulic distributor 15 which can be switched to one of three possible states (shown in the boxes *a*, *b* and *c*) by operating a control device (not shown). The distributor 15, in fact, an auxiliary distributor, is connected by two pipes F and E to a main control distributor 16 which is fed from an oil pump 17, and which communicates with a reservoir 18 via a discharge pipe 19. This distributor 15 can also be switched to one of three positions, indicated by boxes *d*, *e*, and *f*, again by operation of a suitable control device such as a handle or lever (not shown). In the central position, indicated by box *e*, the main distributor 1*b* isolates the auxiliary distributor 15, and therefore the actuators 8 and 12, from the source of fluid pressure (the pump 17 and the reservoir 18) so that they remain fixed in the positions reached. When the main distributor is switched to the position indicated by box *a* the pump is connected to supply fluid under pressure to line E, and Line F is connected to the reservoir: When the main distributor is switched to the position indicated by box *f*, the reverse situation obtains, with the line F being fed with fluid pressure and the line E being connected to the reservoir.

Although there are two actuators 8 and two actuators 12, the following description will, for convenience, refer to one only of each.

When the auxiliary distributor 15 is switched to the position marked *a* the line E is connected to the line B which feeds the retracting input of the actuator 8 and the line F is connected to the line D which communicates with the retracting input of the actuator 12. The two advancing inputs to the actuators 8 and 12 are connected to respective lines A and C which are connected together by the auxiliary distributor in this position. Thus the actuators 8 and 12 are connected in series such that fluid driven from one by displacement of its piston will be transferred to the other via the lines A and C so that, depending on the position of the main actuator 16, the two actuators 8 and 12 can be driven such that one advances while the other retracts, the relative displacement of each depending on their relative diameters. By suitably selecting the relative diameters of the actuators 8 and 12 it can be arranged, as shown in FIG. 1, that the rotation of the tool support frame 5 (and thus the tool 6) exactly compensates the rotation of the arm 3 so that the tool 6 maintains a predetermined inclination with respect to the ground. The device thus acts in the "parallelogram-linkage" mode of operation, the tool 6 moving between the position shown in solid outline in FIG. 1, and the position shown in broken outline in FIG. 1 as the actuators 8 and 12 are moved. With the distances between the various fulcra illustrated in the drawings the attitude variation of the tool 6 relative to the ground does not in fact exceed ½% during its travel from one end position to the other.

Ideally, for "parallelogram" type movement the tool 6 should be substantially vertical as shown in FIG. 1. If, on checking, it is found not to be vertical adjustment can be made as follows: First the auxiliary distributor is switched to the position indicated by the box *b*. This has the effect of isolating the lines A and B which feed each end of the elevation control actuator 8 and connecting the lines C and D to the lines E and F so that by switching the main distributor to position *d* or position *f* the tool-carrying frame 5 can be turned by extension or retraction of the actuator 12, with respect to the arm 3, (which is held fixed by the isolated actuator 8) in order to achieve the desired orientation of the tool 6.

If, on the other hand, the auxiliary distributor is switched to the position indicated by the box *c* the actuator 12 is isolated and held fixed while the actuator 8 controlling elevation of the arm 3 can be operated by switching the main distributor. In this case the device acts in the "radial arm" mode of operation with the tool 6 at a fixed inclination with respect to the arm 3. Again, this fixed orientation can be adjusted by switching the auxiliary distributor to the position *b* and operating the main distributor.

FIGS. 5 to 8 illustrate a second embodiment of the invention which differs from the first embodiment in that the attitude control cylinders 12, instead of linking the arm 3 and the tool-carrying frame 5, connect the tool-carrying frame 5 and the support structure 1, being pivoted to the latter by means of pivot pins 20. With this arrangement the parallelogram-type operation remains unchanged, while in the radial form of operation (see FIG. 7) the lifting arm 3 and the attitude control actuator 12 cause the tool 6 to rotate advantageously around a notional axis 21 located at the intersection of the lines of action of the actuators 12 and the line joining the pivots 2 and 4, which moves in space. In this case the variation in the angle between the arm 3 and the tool (ripper) 6 is insignificant for all practical purposes.

In the embodiments described, in order to obtain the desired modes of operation, the relative sizes, (diameter and stroke) of the actuators 8 and 12 must be determined in accordance with the following considerations.

In the case of the embodiment illustrated in FIGS. 1 to 4, after establishing the geometry of the tool and the maximum desired angle of excursion $\alpha$ of the arm 3 which is also the angle through which the tool-carrying frame 5 must rotate with respect to the arm 3, in order to remain in the same orientation at each end of the range of movement of the arm 3, the diameter D of the attitude control cylinder 12 required to achieve the desired effect can be calculated from the expression $V = \pi D^2/4$ where: V = the volume of oil that the cylinder 12 must receive from the lifting cylinder 8 during the rotation of the arm 3 through the angle $\alpha$. The value of V is given by the relation $$V = \frac{\pi D_1^2}{4} C_1$$

where $D_1$ is the diameter of the cylinder 8, and $C_1$ the stroke of its piston as the arm 3 turns through the angle $\alpha$.

In the case of the embodiment shown in FIGS. 5 to 8, after establishing the geometry of the ripper in the extreme positions (see FIG. 5) and the internal diameter $D_1'_1$ of the cylinder 8 as well as the travel $C_1'$ of its piston, it is necessary to calculate the minimum length L of the cylinder 12 (selecting its internal diameter D') that is the separation between the pivots 14, 20.

It can be shown that the minimum length is given by:

$$L_{min.} = \frac{(D_1')^2 \cdot C_1'}{(D')^2} + I$$

($I$ is a factor related to the constructional dimensions)

and the maximum length is given by:

$$L_{max} = 2. \frac{(D_1')^2 \cdot C'}{(D')^2} + I$$

An arc of radius Lmin is then traced with its centre on the axis of the pivot 14 when the latter is in the lower-most position at the bottom (see FIG. 5), and an arc of radius Lmax is traced with its centre on the axis of the pivot 14 when the latter is in the uppermost position at the top. The intersection of these arcs defines the position of the axis of the fulcrum 20 on the support 1. The deviation from parallelism of the ripper does not exceed ½ when passing from one extreme position to the other.

What is claimed is:

1. In a scarifier or ripper device of the type comprising;

a support structure attachable to a tractor or like vehicle, an arm pivotally attached at one end thereof to said support structure, a tool-carrying frame pivotally attached to the other end of said arm said tool-carrying frame carrying at least one scarifier or ripper tool, at least one elevation control fluid pressure actuator interconnecting said fixed support structure and said arm whereby to control, upon extension and retraction, the elevation of said arm with respect to said fixed support structure, at least one attitude control fluid pressure actuator connected to said tool-carrying frame, and operable upon extension and retraction to control the inclination of said tool-carrying frame, and therefore the inclination of said scarifier or ripper tool with respect to said arm, and a main control fluid pressure distributor device operable selectively to supply fluid under pressure to said fluid pressure actuators and to connect them to a reservoir whereby selectively to cause extension or retraction thereof, the improvement comprising, an auxiliary fluid pressure distributor device connected between said fluid pressure actuators and said main control distributor, said auxiliary distributor having three selectable positions, that is:

a. a first position wherein said auxiliary distributor connects said elevation control actuator and said attitude control actuator in series whereby fluid displaced from one of them is fed to the other in such a way that one retracts when the other extends;

b. a second position wherein said auxiliary distributor isolates and blocks said elevation control actuator and connects said attitude control actuator to said main control distributor whereby to obtain independent control of the inclination of said tool-carrying frame with respect to said arm; and c. a third position wherein said auxiliary distributor isolates and blocks said attitude control actuator and connects said elevation control actuator to said main distributor whereby to obtain independent control of the inclination of said arm while said tool-carrying frame is held in a fixed inclination with respect thereto;

the relative diameters of said elevation control actuator and said attitude control actuator being such that said tool-carrying frame is turned by said attitude control actuator with respect to said arm by an angle which is equal to the angle turned by said arm with respect to said fixed support structure upon displacement of said elevation control actuator when said auxiliary distributor is in said first position whereby to obtain parallelogram-type movement.

2. The scarifier or ripper device of claim 1, wherein said attitude control actuator is pivotally connected, at the end thereof remote from said tool-carrying frame, to said arm.

3. The scarifier or ripper tool of claim 1, wherein said attitude control actuator is pivotally connected, at the end thereof remote from said tool-carrying frame, to said fixed support structure at a point adjacent the pivot joining said arm to said fixed support structure.

* * * * *